US010321773B2

(12) United States Patent
Ferrer-Walsh

(10) Patent No.: US 10,321,773 B2
(45) Date of Patent: Jun. 18, 2019

(54) PAPERBOARD DISPLAY ASSEMBLY

(71) Applicant: WILLOW GROUP, LTD., Batavia, NY (US)

(72) Inventor: Eudalda Ferrer-Walsh, Batavia, NY (US)

(73) Assignee: WILLOW GROUP, LTD., Batavia, NY (US)

( * ) Notice: Subject to any disclaimer, the term of this patent is extended or adjusted under 35 U.S.C. 154(b) by 0 days.

(21) Appl. No.: 15/609,416

(22) Filed: May 31, 2017

(65) Prior Publication Data

US 2018/0344056 A1 Dec. 6, 2018

(51) Int. Cl.

| | |
|---|---|
| ***A47F 5/11*** | (2006.01) |
| ***G09F 1/06*** | (2006.01) |
| ***A47F 5/10*** | (2006.01) |
| *A47F 5/00* | (2006.01) |

(52) U.S. Cl.

CPC ..... *A47F 5/112* (2013.01); *A47F 5/10* (2013.01); *G09F 1/06* (2013.01); *A47F 5/00* (2013.01)

(58) Field of Classification Search

CPC .... A47F 5/112; A47F 5/10; A47F 5/00; G06F 1/06; G06F 1/04; G06F 1/08; B65D 33/004; B65D 5/0227; B65D 5/0246; B65D 5/0281; B65D 5/06; B65D 5/103; B65D 5/4212; B65D 5/4266

USPC ..... 211/195

See application file for complete search history.

(56) References Cited

U.S. PATENT DOCUMENTS

| | | | | | |
|---|---|---|---|---|---|
| 1,079,158 | A * | 11/1913 | Beatty | A47F 5/112 | 211/72 |
| 1,281,260 | A * | 10/1918 | Anderson | A47F 5/112 | 248/174 |
| 1,379,739 | A * | 5/1921 | Bennett | A47F 5/112 | 211/73 |
| 1,400,190 | A * | 12/1921 | Tucker | A47F 5/112 | 40/539 |
| 1,432,056 | A * | 10/1922 | Dietsche, Jr. | A47F 5/112 | 40/669 |
| 1,440,839 | A * | 1/1923 | Phelps | A47F 5/112 | 248/450 |
| 1,476,860 | A * | 12/1923 | Vergeer | A47F 5/112 | 248/450 |
| 2,237,706 | A * | 4/1941 | Islieb | A47F 5/112 | 229/112 |

(Continued)

*Primary Examiner* — Patrick D Hawn

(74) *Attorney, Agent, or Firm* — Brian B. Shaw, Esq.; Jodi A. Reynolds, Esq.; Harter Secrest & Emery LLP

(57) ABSTRACT

A display assembly for resting upon a support surface, the display assembly comprising a main body having self-supporting rigidity and substantially disposed in a first plane, the main body having an upper end and a lower end, a collapsible pocket, moveable between a collapsed configuration and an open configuration, the collapsible pocket having four side walls and a bottom wall wherein at least one of the bottom wall and the four side walls includes a fold line, wherein the collapsible pocket is formed of a material having a different thickness than the main body, and a coupler interconnecting the collapsible pocket and the main body, wherein the collapsible pocket in the open configuration and the main body are self-supporting in an upright orientation with the first plane being substantially perpendicular to the support surface.

16 Claims, 5 Drawing Sheets

(56) References Cited

U.S. PATENT DOCUMENTS

| | | | | | |
|---|---|---|---|---|---|
| 2,249,430 | A * | 7/1941 | Lambert | A47F 5/112 | 206/45.29 |
| 4,310,095 | A * | 1/1982 | Fontlladosa | A47F 5/112 | 211/70.1 |
| 4,699,312 | A * | 10/1987 | Owen | G09F 23/10 | 229/112 |
| 5,836,095 | A * | 11/1998 | Crowell | A45C 13/08 | 383/106 |
| 7,222,446 | B2 * | 5/2007 | Foster | G09F 1/04 | 40/124.06 |
| 8,696,203 | B2 * | 4/2014 | Rednour | A63H 3/50 | 206/458 |
| D712,733 | S * | 9/2014 | Thompson | D9/414 | |
| 2013/0292276 | A1 * | 11/2013 | Thompson | B65D 77/003 | 206/223 |
| 2016/0130030 | A1 * | 5/2016 | Schropp | A47F 5/112 | 229/116.1 |

* cited by examiner

PAPERBOARD DISPLAY ASSEMBLY

FIELD OF THE INVENTION

This disclosure relates to a display assembly for resting upon a support surface, and more particularly, to a display assembly having a main body and a collapsible pocket for holding floral, candy, and/or novelty arrangements.

DESCRIPTION OF RELATED ART

There are many occasions in which an individual may wish to give a gift to another. Many people enjoy giving gifts for holidays, weddings, anniversaries, and birthdays. Some also give gifts as an expression of friendship, love, and gratitude. Typically, gifts are wrapped or packaged in some form. For some gifts, however, it is difficult to provide acceptable packaging due to the shape, size, and type of the gift.

Certain stores, for example, grocery stores, drug stores, convenient stores, and florists, have prepared and packaged gifts on display and available for consumers to purchase. These gifts typically include flowers and/or candy arrangements that are assembled on site by an employee. It is difficult, however, to provide such gifts in an attractive display that is also affordable and easy to assemble. For example, some offer candy or flowers in baskets, mugs, or vases. However, baskets, mugs and vases are bulky and difficult to ship and store in large quantities. Further, these items can add significant costs to the arrangement making the gift cost prohibitive for consumers. Baskets are not typically water resistant and may be damaged easily by exposure to moisture from flowers or plants contained therein. Additionally, some consumers prefer items that have a packaged appearance; baskets, mugs and vases alone do not provide the appearance of gift packaging.

A low cost display assembly that is easy to ship and store is needed. Also, a display that is attractive and easy to assembly is needed. A display assembly that is stable without additional support is also needed.

BRIEF SUMMARY OF THE INVENTION

The present disclosure provides a display assembly for resting upon a support surface having a main body and a collapsible pocket.

In one configuration, a display assembly for resting upon a support surface is provided comprising a main body having self-supporting rigidity and substantially disposed in a first plane, the main body having an upper end and a lower end, a collapsible pocket, moveable between a collapsed configuration and an open configuration, the collapsible pocket having four side walls and a bottom wall wherein at least one of the bottom wall and the four side walls includes a fold line. The collapsible pocket is formed of a material of a different thickness than the main body. The display assembly also includes a coupler interconnecting the collapsible pocket and the main body, wherein the collapsible pocket in the open configuration and the main body are self-supporting in an upright orientation with the first plane being substantially perpendicular to the support surface.

In another configuration, a display assembly is provided comprises a main body having self-supporting rigidity and substantially disposed in a first plane, a collapsible pocket, moveable between a collapsed configuration and an open configuration, the collapsible pocket having four side walls and a bottom wall wherein the bottom wall is formed by a plurality of planar flaps moveable between a first planar orientation in the collapsed configuration and a second planar orientation in the open configuration. The display assembly in this configuration includes a coupler interconnecting the collapsible pocket and the main body, wherein the collapsible pocket in the open configuration and the main body are self-supporting in an upright orientation with the first plane being substantially perpendicular to the support surface.

In yet another configuration, a display assembly for resting upon a support surface comprises a main body having self-supporting rigidity and substantially disposed in a first plane, the main body having an upper end and a lower end, the lower end comprising a first edge engaging the support surface and a collapsible pocket, moveable between a collapsed configuration and an open configuration. The collapsible pocket has four side walls and a bottom wall wherein at least one of the bottom wall and the four side walls includes a fold line for collapsing the collapsible pocket, wherein the collapsible pocket is formed of a material of a different thickness than the main body, and wherein at least the bottom wall of the collapsible pocket in the open configuration and at least the bottom edge of the main body are self-supporting in an upright orientation with the first plane being substantially perpendicular to the support surface.

BRIEF DESCRIPTION OF THE SEVERAL VIEWS OF THE DRAWING(S)

The foregoing features of this invention, as well as the invention itself, may be more fully understood from the following description of the drawings in which.

DETAILED DESCRIPTION OF THE INVENTION

At the outset, it should be appreciated that like drawing numbers on different drawing views identify identical structural elements of the invention. While the present invention is described with respect to what is presently considered to be the preferred embodiment, it is understood that the invention is not limited to the disclosed embodiment.

Furthermore, it is understood that the invention is not limited to the particular methodology, materials, and modifications described and as such may vary. It is also understood that the terminology used herein is for the purpose of describing particular elements only, and is not intended to limit the scope of the present invention, which is limited only by the appended claims.

Figure 1:
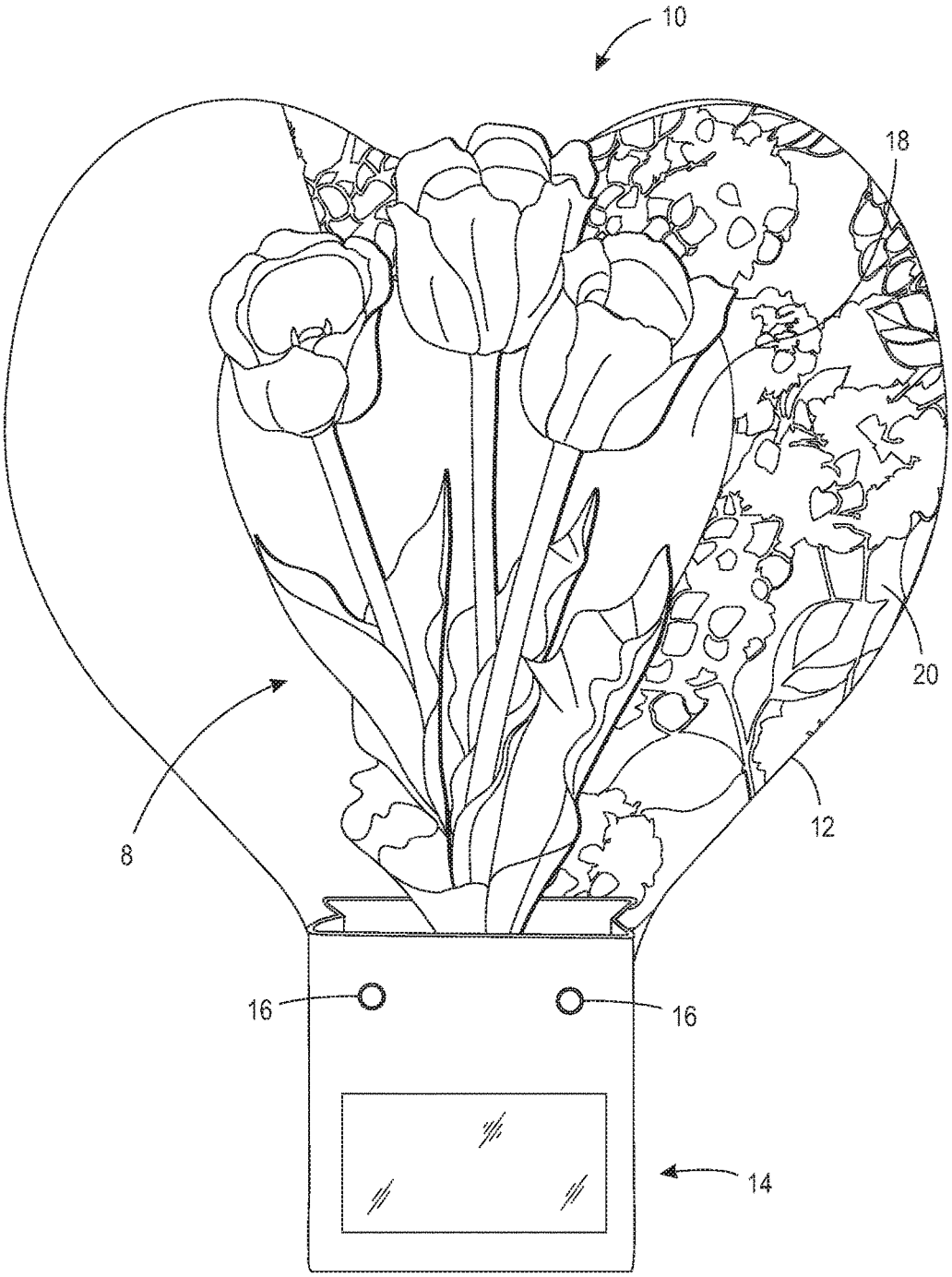
FIG. 1 is a perspective view of an exemplary display assembly showing a pocket in an uncollapsed configuration and a flower arrangement disposed therein.

Referring to the Figures, FIG. 1 is a perspective view of display assembly 10. Display assembly 10 broadly comprises main body 12, collapsible pocket 14 and couplers 16. The display assembly 10 is configured to hold an object 8 to be displayed, for example, a floral arrangement, plants, novelties, candy, and the like. The main body 12 is preferably constructed of a single sheet of a fibrous material such as paperboard, cardboard or similar material. The paperboard material is, in one configuration, formed of a three layered structure having an intermediate board layer and two outer coating layers. Preferably, the paperboard material is approximately 0.083 inches to 0.25 inches thick. More preferably, the paperboard material is approximately 0.125 inches thick. It should be appreciated, however, that other materials and thicknesses that provide enough self-supporting rigidity may be used. Examples of other materials that can be used include plastics or polymeric material, laminates, wood, fabric, and composite material. If the selected material does not offer sufficient self-supporting rigidity, it should be appreciated that the materials may be layered to improve such characteristics.

The main body 12 may be in the form of a decorative shape. For example, the main body 12 may be shaped as a heart, oval, vector frame, start, etc. In one configuration, the main body 12 is shaped according to a theme, for example, a musical theme, sports theme, holiday theme, etc. The shape of the main body 12 may further include an inner area 18 formed by removing a portion of the material of the main body 12. The inner area 18 of the main body 12 may be created by stamping, die-cutting, or press forming, among other techniques. As shown in FIGS. 1-4, for example, the heart-shape of the main body 12 is formed by both the outer perimeter and the inner perimeter. A top layer 20 of the main body 12 may further include decorative elements to provide visual impact. For example, the top layer 20 of the main body 12 may include printed matter by using paint, dry printing, metallic ink and/or foil elements, film laminates, and/or high gloss coatings, among other things. The top layer 20 of the main body 12 may further include textured effects, for example, by embossing.

Figure 2:
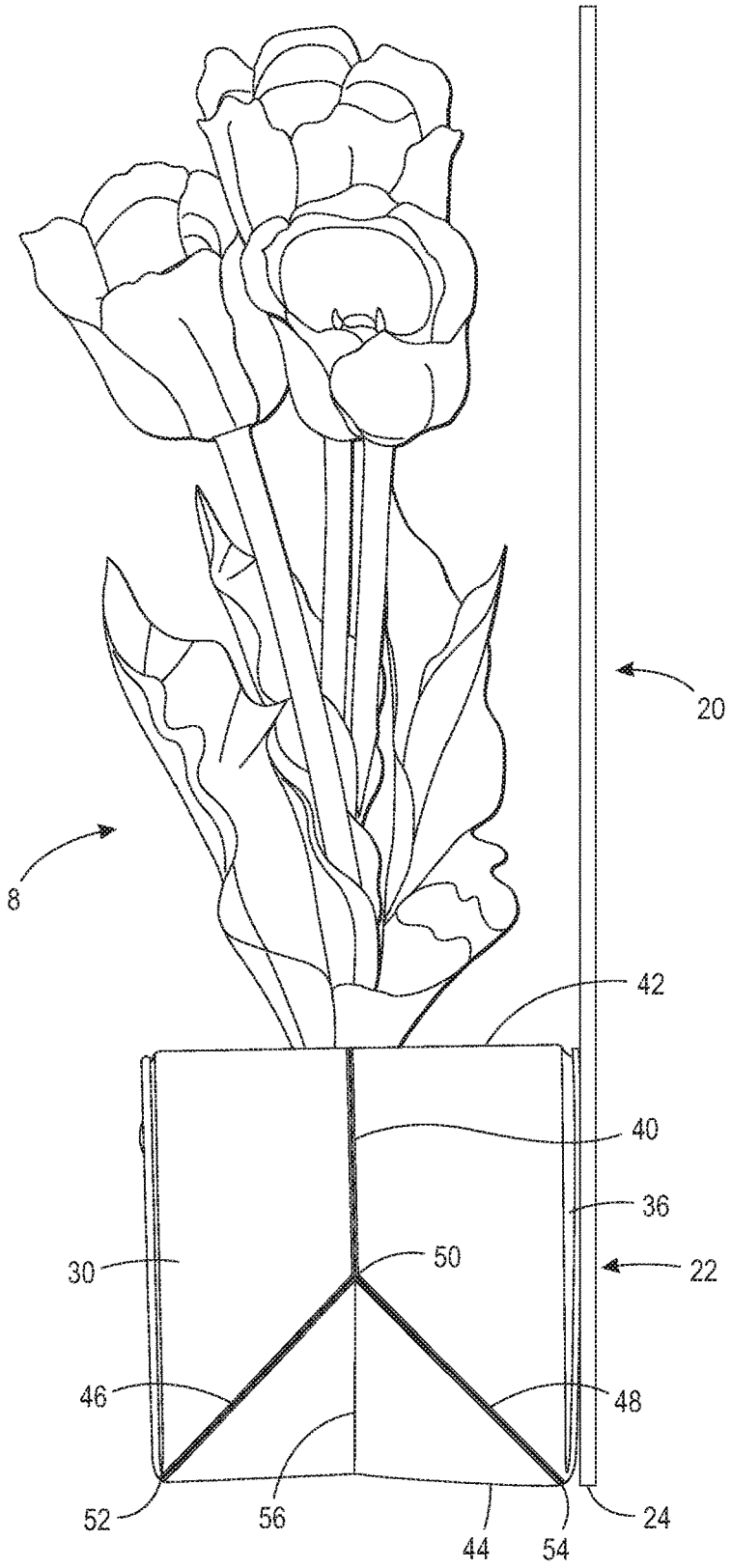
FIG. 2 is a right side view of the exemplary display assembly showing the pocket in the uncollapsed configuration and a flower arrangement disposed therein.
Figure 3:
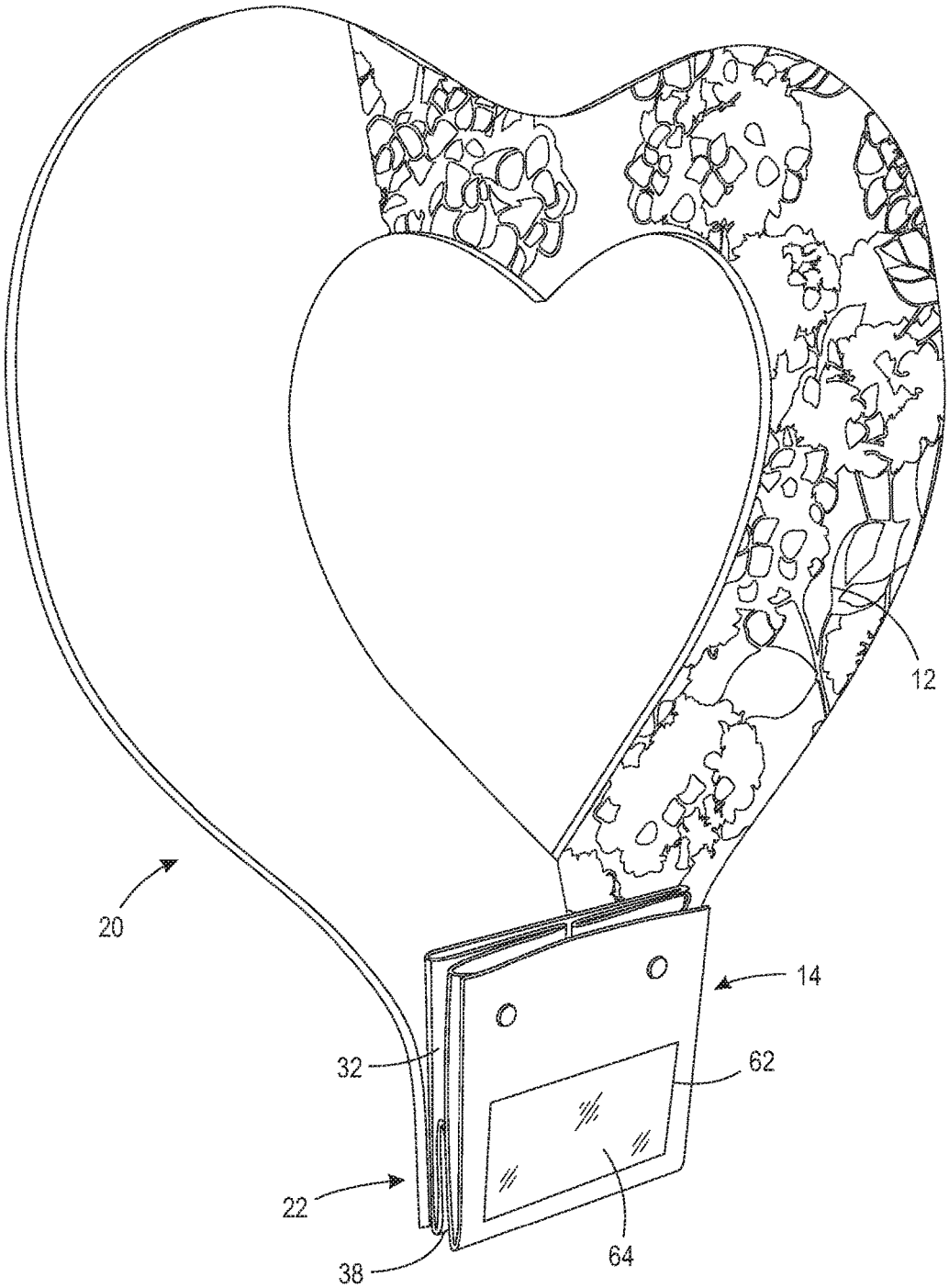
FIG. 3 is a perspective view of the exemplary display assembly showing the pocket in a collapsed configuration.

As shown in FIGS. 2 and 3, the main body 12 includes an upper display end 20 and a lower end 22. Preferably, the main body 12 has a height of at least twice the height of the collapsible pocket 14 in the open configuration. In one configuration, the main body 12 has a height of approximately 15 inches, while the collapsible pocket 14 has a height of approximately 4 inches. Moreover, preferably at least a portion of the upper end 20 is viewable when the display assembly 10 is holding a display object 8. In a configuration, the lower end 22 is sized to be approximately the same shape and size as the collapsible pocket 14. The lower end 22 includes a bottom edge 24 that engages a support surface, for example a table, shelf, or other type of display surface. The bottom edge 24, along with the bottom wall 38 of the collapsible pocket 14, is coplanar in the open position of the pocket 14 and engages the support surface. This results in the main body 12 being disposed in a substantially vertical plane assuming a first angle of approximately 90 degrees relative to the support surface. The center of gravity of the main body 12 is within a footprint of the bottom wall 38 of the collapsible pocket 14 in the open configuration. Thus, the display assembly 10 is stable and capable of maintaining the main body 12 in the substantially vertical position, whether or not the pocket 14 in the open configuration includes a display object 8.

The collapsible pocket 14 is preferably constructed of a water resistant, single sheet of a fibrous material such as paperboard, cardboard or similar material. The collapsible pocket 14, however, is preferably a material having a thickness less than the thickness of the main body 12. In one configuration, the collapsible pocket 14 is made of a coated paperboard. In another configuration, the collapsible pocket 14 is a folding carton board having a calipers ranging from 12 pt through 28 pt and that is FDA certified for contacting dry or aqueous foods. An example of a material that can be used is a double clay-coated SBS, such as the EVEREST® Folding Carton Board made by International Paper having its global headquarters at 6400 Poplar Avenue, Memphis, Tenn. 38197. The collapsible pocket 14 may include an opening 62. The opening may include a clear protective layer forming a window 64. For example, in one configuration, the collapsible pocket 14 includes a polyvinyl chloride window. It should be appreciated, however, that other materials may be suitable for forming the window. Further, windows may be included on all sidewalls or any combination of sidewalls.

Figure 4:
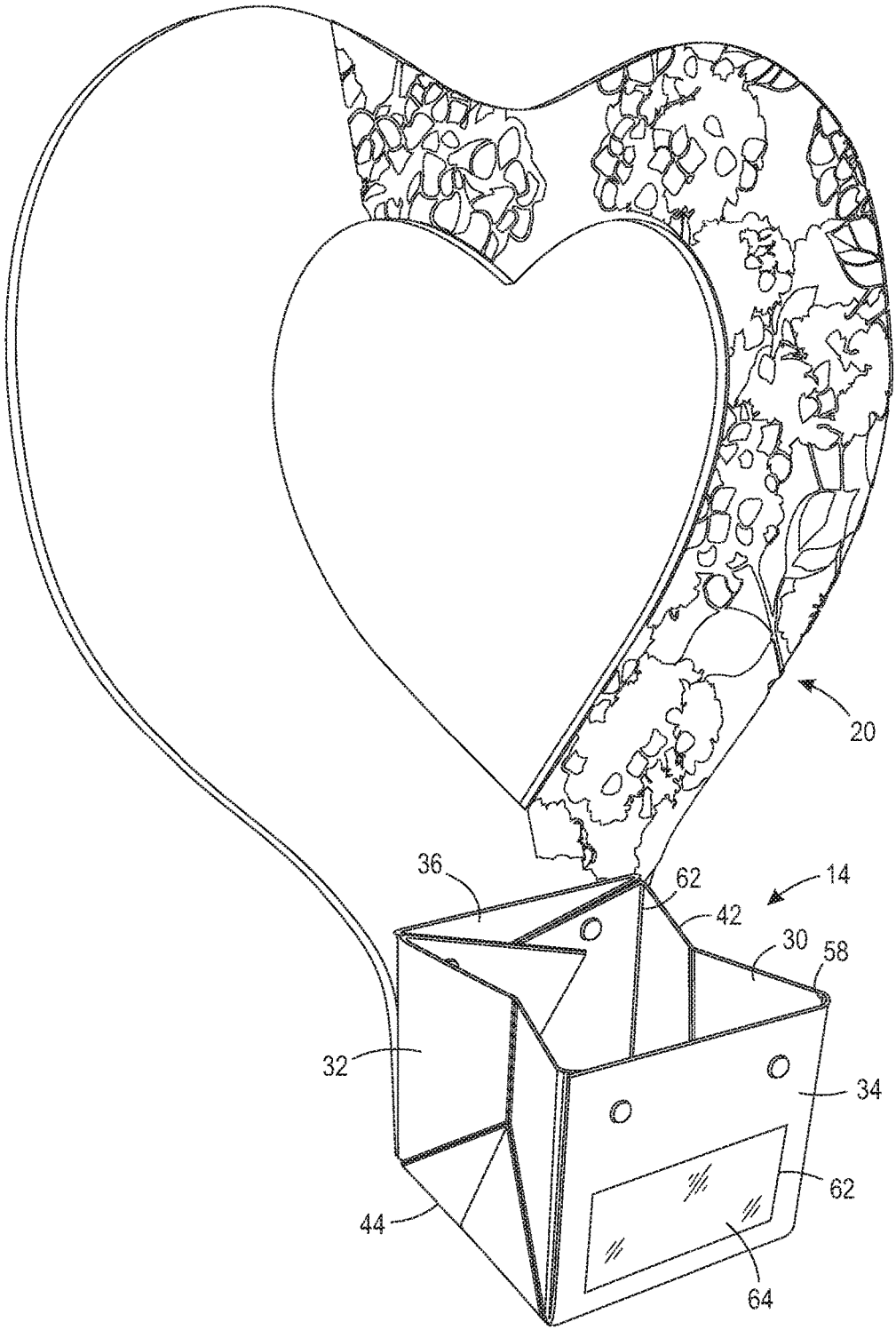
FIG. 4 is a perspective view of the exemplary display assembly showing the pocket in an uncollapsed configuration without a flower arrangement disposed therein.

As shown in FIGS. 2-4, the collapsible pocket 14 is moveable between a collapsed configuration and an open configuration. The collapsible pocket 14 includes four side walls 30, 32, 34, and 36. In a configuration, the collapsible pocket 14 further includes a bottom wall 38. In a configuration, the collapsible pocket 14 has a length, height and width of approximately 4 inches each. However, it should be appreciated that other shapes and sizes may be used and these modifications are intended to be included within the scope of the claims.

Sidewalls 30, 32 are symmetrical and include fold lines that enable the pocket to be collapsed. In a configuration, sidewalls 30, 32 each include a center fold line 40 that extends vertically from an upper perimeter edge 42 of the collapsible pocket 14 toward a lower perimeter edge 44 of the collapsible pocket 14. In a configuration, the center fold line 40 extends vertically beyond the mid-point of each sidewall 30, 32. The sidewalls 30, 32 further include two additional fold lines 46, 48 extending diagonally from, and intersecting, at intersection 50 of the center fold line 40 to the lower corners 52, 54 of the sidewalls. The fold lines 40, 46, 48 form an inverted Y-shape on each of the sidewalls 30, 32 and are preferably double-fold lines on the outer face of the collapsible pocket 14. An additional fold line 56 extends vertically from the end point 50 of the center fold line 40 to the lower perimeter edge 44 of the sidewalls 30, 32. Fold line 56 is a double fold line on the inner face of the collapsible pocket 14.

Figure 5:
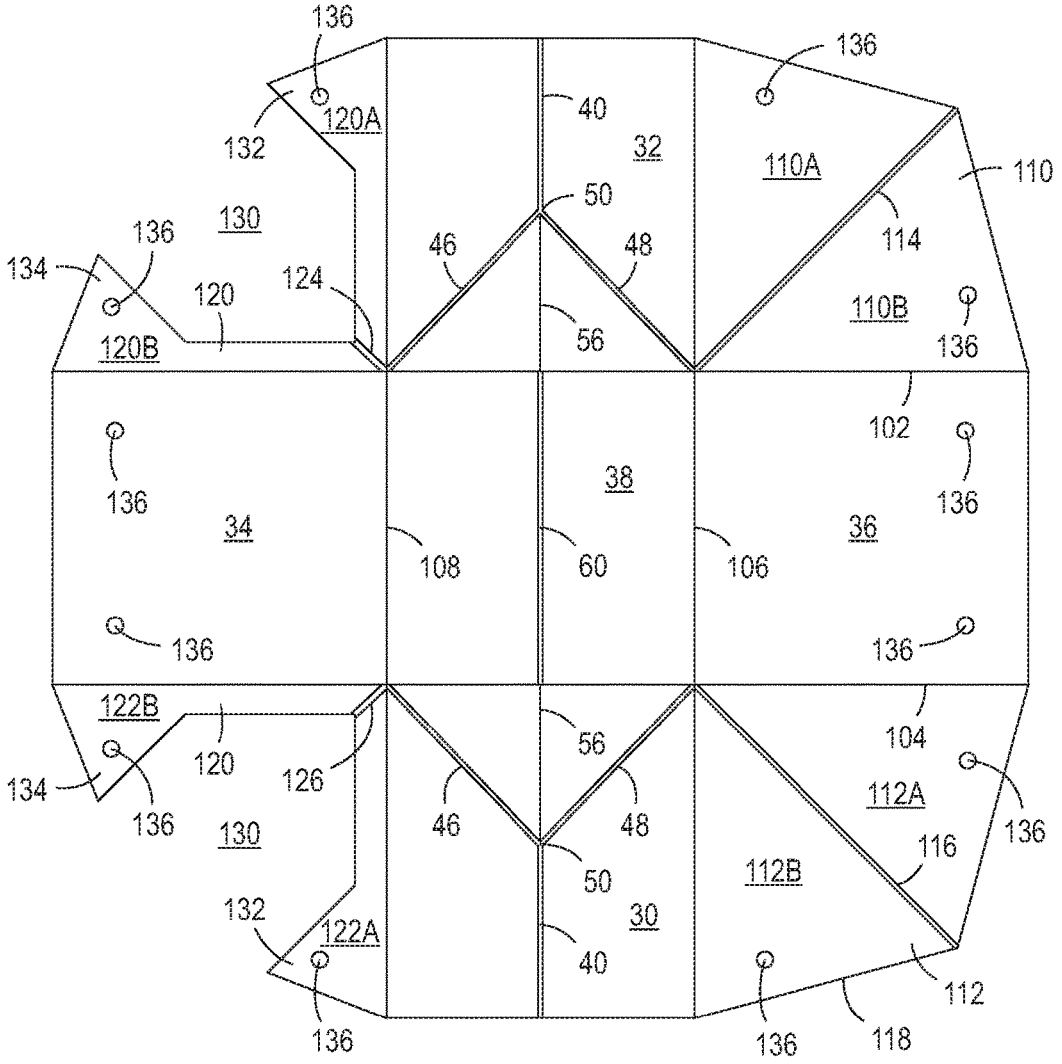
FIG. 5 is a bottom view of an exemplary blank construction of the display assembly.

A double fold line 60, as shown in FIG. 5, extends across the bottom wall 38 and is horizontally aligned with the single fold line 56 at each lower perimeter edge 44 of the sidewalls 30, 32. In particular embodiments, the center fold line 40, fold lines 46, 48, and fold line 56 are positioned in their respective sidewalls 30, 32 so as to be mirror images of one another.

Referring to FIG. 5, a blank construction 100 from which the collapsible box 14 is formed is shown. As described above, the blank 100 comprises a sheet of foldable material, for example, cardboard or the like, and is formed with two opposing longitudinally extending fold lines 102, 104 and two opposing transversely extending fold lines 106, 108, which intersect to define the sidewalls 30, 32, 34, and 36 and bottom wall 38. The sidewalls 30, 32, 34, and 36 are planar flaps that are hingedly coupled about the bottom wall 38 along the respective longitudinally extending fold lines 102, 104 and transversely extending fold lines 106, 108. Corner flap 110 is defined by the longitudinally extending fold line 102 and the intersecting, transversely extending fold line 106. Similarly, corner flap 112 is defined by the longitudinally extending fold line 104 and the intersecting, transversely extending fold line 106. Corner flap 110 is positioned between sidewalls 32 and 36 and interconnected thereto, while corner flap 112 is positioned between sidewalls 30 and 36 and interconnected thereto. Each corner flap includes a diagonal fold line 114, 116 extending from a perimeter edge 118 of the blank 100 to the intersection of the respective fold lines 102, 106 and 104, 106. In a configuration, each diagonal fold line 114, 116 is longer than each of the portion of fold lines 102, 104,106 forming sidewalls 30, 32, and 36. The diagonal fold lines 114, 116 define corner flap portions 110A, 110B and 112A, 112B, which are hingedly coupled along diagonal fold lines 114, 116, respectively. Corner flap portion 110A is also hingedly coupled to transversely extending fold line 106, while corner flap portion 110B is also hingedly coupled to longitudinally extending fold line 102. Corner flap portion 112A is hingedly coupled to longitudinally extending fold line 104, while corner flap portion 112B is hingedly coupled to transversely extending fold line 106. Accordingly, the pocket 14 is formed, in part, by the diagonal fold lines 114, 116 of corner flaps 110, 112 being forced inwardly, wherein the outer face of corner flap portion 110A and 110B are moved adjacent to each other and the outer face of corner flap portion 112A and 112B are moved adjacent to each other. The corner flaps 110, 112 may be removeably or fixedly attached to sidewalls 30, 32 or sidewall 36 as discussed in more detail below.

In a configuration of the invention, the blank 100 further includes corner flaps 120, 122. Corner flap 120 is defined by the longitudinally extending fold line 102 and the intersecting, transversely extending fold line 108. Corner flap 122 is defined by the longitudinally extending fold line 104 and the intersecting, transversely extending fold line 108. Corner flap 120 is positioned between sidewalls 32 and 34 and interconnected thereto, while corner flap 122 is positioned between sidewalls 30 and 34 and interconnected thereto. Each corner flap 120, 124 may further include a diagonal fold line 124, 126 extending from a perimeter edge 120 of the blank 100 to the intersection of the respective fold lines 102, 108 and 104, 108, respectively. In a configuration, the diagonal fold line 124, 126 is longer than each of the portion of fold lines 102, 104,108 forming sidewalls 30, 32, and 34. The diagonal fold lines 124, 126 define corner flap portions 120A, 120B and 122A, 122B, which are hingedly coupled along diagonal fold lines 124, 126, respectively. Corner flap portion 120A is also hingedly coupled to transversely extending fold line 108, while corner flap portion 120B is also hingedly coupled to longitudinally extending fold line 102. Corner flap portion 122A is hingedly coupled to longitudinally extending fold line 104, while corner flap portion 112B is hingedly coupled to transversely extending fold line 108.

In another configuration, however, corner flaps 120, 122 and/or corner flaps 110, 112 include a cut away portion 130 and opposing tabs 132, 134. Having cut away portions 130 reduces the bulkiness of the material within the pocket 14, while still providing structural stability. Accordingly, in one configuration, an outer face of each opposing tab 132, 134 is moved adjacent to the other to further form the pocket 14. The opposing tabs 132 may be attached or adhered to each other as described in more details below. In an alternative configuration, the pocket 14 is further formed by the diagonal fold lines 124, 126 of corner flaps 120, 122 being forced inwardly, wherein the outer face of corner flap portions 120A and 120B are moved adjacent to each other and the outer face of corner flap portions 122A and 122B are moved adjacent to each other.

It should be appreciated by those having ordinary skill in the art that the direction of the folding can be facilitated by the type of fold line used and the face location of such fold line. For example, a double fold line used on an inner face of a blank between two sidewalls will promote the two sidewall faces to move towards one another. A double fold line used on the opposite side that is on the outer face of the sidewalls will promote the two outer faces of the sidewalls to move together.

Once assembled, the collapsible pocket 14 may be moved between a collapsed and an open position. To collapse the pocket 14, inward pressure is applied to sidewalls 30, 32, causing the sidewalls 30, 32 to move inwardly along double fold line 40. Pressure applied to the bottom wall 38 along double fold line 60 forces the bottom wall 38 to fold inwardly and the sidewalls 30, 32 to then fold along double fold lines 46, 48. As the bottom wall 38 moves upwardly into the interior space of the pocket 14, the angle at intersection 50 decreases, and the sidewall 34 moves toward sidewall 36. In the fully collapsed position, sidewall 34 is adjacent sidewall 36, with sidewalls 30 and 32 collapsed and positioned between sidewalls 34 and 36. Thus, the sidewall 30 moves between a planar orientation in an open configuration to a second planar orientation in the collapsed configuration.

As shown in the figures, the collapsible pocket 14 may be secured to the main body 12. For example, the sidewall 36 of the collapsible pocket 14 may be fixedly secured to the main body 12 using rivets, pins, staples, adhesive, tape, and the like. In one configuration, the corner flaps 110, 112 are also secured to the sidewall 36 and corner flaps 120, 122 are secured to the sidewall 34 to help maintain the form of the pocket 14 in the assembled configuration. In an alternative configuration, two sets of opposing tabs 132, 134 may be secured to the sidewall 34. The blank 100 may include apertures for receiving rivets. For example, as shown in FIG. 5, the blank 100 includes apertures 136 within each of the corner flap portions 110A, 110B, 112A, 112B and within each set of opposing tabs 132, 134.

The present disclosure contemplates that many changes and modifications may be made. Therefore, while the presently preferred form of the assembly has been shown and described, and several modifications and alternatives discussed, persons skill in the art will readily appreciate that various additional changes and modifications may be made without departing form the scope of the disclosure, as defined and differentiated by the following claims.

The invention claimed is:

1. A display assembly for resting upon a support surface, the display assembly comprising:

(a) a main body having self-supporting rigidity and substantially disposed in a first plane, the main body having an upper end and a lower end, the lower end having at least one aperture;

(b) a collapsible pocket, moveable between a collapsed configuration and an open configuration, the collapsible pocket having a front wall, a back wall, side walls, at least two corner flap portions overlying the back wall, and a bottom wall;

wherein the bottom wall includes a transverse fold line along the bottom wall and the side walls include a fold line, wherein the collapsible pocket is formed of a material of a different thickness than the main body, and wherein the back wall of the collapsible pocket and each of the at least two corner flap portions includes at least one aperture, wherein each corner flap portion aperture aligns with a corresponding one of the at least one aperture of the back wall and with a corresponding one of the at least one aperture of the lower end of the main body to form at least one set of aligned apertures; and (c) a coupler inserted through the at least one set of aligned apertures, wherein the collapsible pocket in the open configuration and the main body are self-supporting in an upright orientation with the first plane being substantially perpendicular to the support surface.

2. The display assembly of claim 1, wherein the front wall includes a window.

3. The display assembly of claim 1, wherein a center of gravity of the combined main body and collapsible pocket is within a footprint of the bottom wall of the collapsible pocket in the open configuration of the assembly.

4. The display assembly of claim 1, wherein a height of the main body is at least twice a height of the collapsible pocket in the open configuration.

5. The display assembly of claim 1, wherein the front wall, back wall, sidewalls and bottom wall are water resistant.

6. The display assembly of claim 1, wherein the bottom wall of the collapsible pocket and the lower end of the main body are coplanar in the open configuration.

7. The display assembly of claim 1, wherein the side walls of the collapsible pocket include at least a front side wall and a back side wall, and wherein a substantial portion of the front side wall overlaps a substantial portion of the back side wall in the collapsed configuration.

8. A display assembly comprising:

(a) a main body having self-supporting rigidity, substantially disposed in a first plane, and at least one aperture;

(b) a collapsible pocket, moveable between a collapsed configuration and an open configuration, the collapsible pocket having a front wall, a back wall, at least two corner flap portions overlying the back wall, side walls, and a bottom wall having a transverse fold line along the bottom wall, and a bottom wall;

wherein the bottom wall is formed by a plurality of planar flaps moveable between a first planar orientation in the collapsed configuration and a second planar orientation in the open configuration, and wherein the back wall of the collapsible pocket and each corner flap portion each includes at least one aperture positioned to align with a corresponding one of the at least one aperture of the main body in a first position to form at least one set of aligned apertures; and (c) at least one coupler, each coupler inserted through the at least one set of aligned apertures to interconnect the collapsible pocket and the main body, wherein the collapsible pocket in the open configuration and the main body are self-supporting in an upright orientation with the first plane being substantially perpendicular to the support surface.

9. The display assembly of claim 8, wherein a center of gravity of the combined main body and collapsible pocket is within a footprint of the bottom wall of the collapsible pocket in the open and upright configuration of the assembly.

10. The display assembly of claim 8, wherein a height of the main body is at least twice a height of the collapsible pocket.

11. The display assembly of claim 8, wherein the main body further comprises a lower end having a bottom edge, and wherein the bottom edge engages a support surface.

12. A display assembly for resting upon a support surface, the display assembly comprising:

(a) a main body having self-supporting rigidity and substantially disposed in a first plane, the main body having an upper end, a lower end, and at least one aperture, the lower end comprising a first edge engaging the support surface; and (b) a collapsible pocket, moveable between a collapsed configuration and an open configuration, the collapsible pocket having a front wall, a back wall, at least two corner flap portions overlying the back wall, side walls, and a bottom wall, wherein the bottom wall includes a transverse fold line along the bottom wall and the side walls include a fold line for collapsing the collapsible pocket, wherein the collapsible pocket is formed of a material of a different thickness than the main body, wherein the back wall of the collapsible pocket and each corner flap portion includes at least one aperture aligned with a corresponding one of the at least one aperture of the main body to form at least one set of aligned apertures, and wherein at least the bottom wall of the collapsible pocket in the open configuration and at least the bottom edge of the main body are self-supporting in an upright orientation with the first plane being substantially perpendicular to the support surface; and at least one coupler inserted through the at least one set of aligned apertures.

13. The display assembly of claim 12, wherein the at least one coupler is a rivet.

14. The display assembly of claim 12, wherein the lower end of the main body and the collapsible pocket each have a width, and wherein the width of the lower end of the main body is substantially the same as the width of the collapsible pocket.

15. The display assembly of claim 12, wherein the collapsible pocket is formed of a blank having two opposing longitudinally extending fold line and two opposing transversely extending fold lines, forming the front wall, the back wall, the sidewalls, the bottom wall, and four corner flaps having diagonal fold lines, wherein at least two of the four corner flaps have cut away portions and tabs for securing the corner flaps to one of the sidewalls in the assembled position.

16. The display assembly of claim 15, further comprising couplers for interconnecting the tabs to one of the sidewalls in the assembled position.

* * * * *